US005144722A

United States Patent [19]

Salice

[11] Patent Number: 5,144,722

[45] Date of Patent: Sep. 8, 1992

[54] FURNITURE HINGE

[75] Inventor: Luciano Salice, Carimate, Italy

[73] Assignee: Arturo Salice S.p.A., Novedrate, Italy

[21] Appl. No.: 707,294

[22] Filed: May 30, 1991

Related U.S. Application Data

[63] Continuation of Ser. No. 535,711, Jun. 11, 1990, abandoned.

[30] Foreign Application Priority Data

Jun. 20, 1989 [DE] Fed. Rep. of Germany ..... 3920141

[51] Int. Cl.[5] ..... E05D 7/04

[52] U.S. Cl. ..... 16/240; 16/245; 16/246; 16/DIG. 43

[58] Field of Search ..... 16/236, 240–241, 16/245–246, 382, DIG. 43

[56] References Cited

U.S. PATENT DOCUMENTS

| | | | |
|---|---|---|---|
| 4,007,514 | 2/1977 | Salice | 16/240 |
| 4,674,150 | 6/1987 | Salice | 16/382 |

FOREIGN PATENT DOCUMENTS

| | | | |
|---|---|---|---|
| 168595 | 1/1986 | European Pat. Off. | 16/DIG. 43 |
| 2819100 | 11/1978 | Fed. Rep. of Germany | 16/DIG. 43 |
| 3423253 | 1/1986 | Fed. Rep. of Germany . | |
| 3442421 | 1/1986 | Fed. Rep. of Germany . | |
| 3510442 | 9/1986 | Fed. Rep. of Germany | 16/366 |
| 3920141 | 8/1990 | Fed. Rep. of Germany . | |
| 2297973 | 1/1975 | France . | |

*Primary Examiner*—Richard K. Seidel

*Attorney, Agent, or Firm*—Fleit, Jacobson, Cohn, Price, Holman & Stern

[57] ABSTRACT

A furniture hinge comprises a pivotally movable hinge member, which is adapted to be secured to a door or flap and is connected by two links to a hinge bracket, which is adapted to be connected to a base plate, which is adapted to be secured to a carrying wall. The bracket is slidably guided on the base plate at least in the direction of the depth of a piece of furniture and is adapted to be secured thereto in various depths of insertion by a clamp screw. A stop is provided for limiting the insertion of the hinge bracket in the direction of the depth of the piece of funiture. In order to ensure that the gap between the door and the corups of the furniture will have a predetermined width after the hinge bracket has been pivotally moved to effect a lateral adjustment of the door, an adjusting screw which bears on the base plate is screwed into the hinge bracket and is operable to impart to said hinge bracket a pivotal movement for effecting a lateral adjustment of the door or flap. The stop is constituted by a beveled or curved edge portion or surface of the hinge bracket or of the base plate, and the respective other part consisting of the base plate or the hinge bracket comprises a counterstop, which bears on the stop in such a manner that the gap between the end face of the carrying wall or the corupus part of the furniture and the inside surface of the door will substantially have a predetermined width after a lateral adjustment of the door when the counterstop bears on the beveled or curved edge portion or surface after the lateral adjustment.

5 Claims, 1 Drawing Sheet

FURNITURE HINGE

This is a continuation of application Ser. No. 07/535,711, filed Jun. 11, 1990 which was abandoned upon the filing hereof.

BACKGROUND OF THE INVENTION

1. Field of the Invention

This invention relates to a furniture hinge comprising a pivotally movable hinge member, which is adapted to be secured to a door or flap and is connected by two links to a hinge bracket, which is adapted to be connected to a base plate, which is adapted to be secured to a carrying wall, wherein said bracket is slidably guided on said base plate at least in the direction of the depth of a piece of furniture and is adapted to be secured thereto in various depths of insertion by a clamp screw, and a stop is provided for limiting the insertion of the hinge bracket in the direction of the depth of the piece of furniture.

2. Description of the Prior Art

Owing to inevitable tolerances and inaccuracies in the manufacture, furniture hinges may have to be adjusted during or after the operation by which they are mounted on furniture. A readjustment of furniture hinges may be required also during their use because doors or other parts of furniture have sunk or have been displaced.

In a furniture hinge which is of the kind described first hereinbefore and has been disclosed in German Patent Specification 26 42 287 the insertion of the hinge bracket on the base plate in the direction of the depth of the piece of furniture is limited by a pin, which is provided at the inner end of the base plate and which is struck by that edge of the hinge bracket which is the leading edge as the bracket is inserted. If the hinge bracket is pushed against that pin as the door or the like is being mounted and the hinge bracket is subsequently clamped against the base plate by the clamp screw, the door or the like will be properly aligned in the direction of the depth of the furniture if the piece of furniture and the hinge have been manufactured with adequate precision and if the mounting operation has properly been performed with the required positional accuracy. But if a readjustment is nevertheless required, it will be necessary in the use of the known hinge to break off the pin which constitutes the stop so that changes, particularly subsequently occurring changes, of the dimensional accuracy of the cor-pus of the cupboard or cabinet can be compensated by an adjustment of the position of the hinges.

For instance, when a door is laterally adjusted in that the hinge bracket is pivotally moved away from the carrying wall to which the bracket has been secured, the hinge bracket will include an obtuse angle with the door in a position which corresponds to a slightly opened position of the door although the door is in its closed position because it bears on corpus parts or on a door frame. Because by that lateral adjustment the links are pivotally moved in the sense of a slight movement of the door, the gap between the end face of the carrying wall and the door will be increased. If such a lateral adjustment were permitted by the hinge which is known from German Patent Specification 26 42 287, it would be necessary after each lateral adjustment to readjust the hinge bracket also in the direction of the depth of the piece of furniture and this would require that the stop pin is broken off.

In a hinge which is known from German Patent Specification 34 42 421 the initially adjusted width of the gap between the inside surface of the door and the end face of the corpus of the furniture will be maintained and will not be changed as the hinge bracket is pivotally moved for a lateral adjustment. This is accomplished in that the hinge bracket is guided in such a manner in guides of an intermediate plate, which is connected to the base plate, that a pivotal movement of the hinge bracket will result in a displacement of the hinge bracket on the intermediate plate to the extent to which the width of said gap is changed by the pivotal movement. Whereas that known furniture hinge can very conveniently be mounted, its manufacture is relatively expensive because it is necessary to provide an intermediate plate, which is longitudinally slidable relative to the base plate and provided with oblique guides for the hinge bracket.

SUMMARY OF THE INVENTION

For this reason it is an object of the invention to provide a furniture hinge which is of the kind described first hereinbefore and in which it is ensured by simple means that the gap between the end face of the corpus of the furniture and the inside surface of the door will substantially have a predetermined width after a pivotal movement has been imparted to the hinge bracket for a lateral adjustment of the door.

In a furniture hinge which is of the kind described first hereinbefore that object is accomplished in accordance with the invention in that an adjusting screw which bears on the base plate is screwed into the hinge bracket and is operable to impart to said hinge bracket a pivotal movement for effecting a lateral adjustment of the door or flap, the stop is constituted by a beveled or curved edge portion or surface of the hinge bracket or of the base plate, and the respective other part consisting of the base plate or the hinge bracket comprises a counterstop, which bears on said stop in such a manner that the gap between the end face of the carrying wall or the corpus part of the furniture and the inside surface of the door will substantially have a predetermined width after a lateral adjustment of the door when the counterstop bears on the beveled or curved edge portion or surface after said lateral adjustment. If a door which has been mounted by means of the furniture hinge in accordance with the invention must be laterally adjusted, the door will be forced into the interior of the furniture before the clamp screw is tightened. As a result, the hinge bracket and the base plate bear on each other at the stop which is constituted by the beveled or curved edge portion or surface and the counterstop so that it is ensured that the gap will substantially have a predetermined width when the lateral adjustment has been effected. Once the width of the gap has been adjusted in the initially adjusted hinge, the gap will no longer be changed by a lateral adjustment if such adjustment is required, provided that the stop and the counterstop are forced against each other before the clamp screw is tightened. The desired initial adjustment may be effected by a suitable adjustment of the base plate on the carrying wall and a suitable adjustment may be facilitated in that the base plate is made of two parts.

On principle, the beveled or curved edge portions or surfaces may be provided on the hinge bracket or on the base plate and the other part may be provided only with a counterstop which is constituted by a transversely extending edge. But in a desirable arrangement the flanges of the channel-shaped hinge bracket are provided near that end which is adjacent to the hinge axis with step-forming beveled edge portions, which are adapted to bear on a transversely extending edge at the forward end of the base plate. The base plate is desirably symmetrical with respect to its transverse center line so that the base plate can be mounted in any position.

In accordance with a further feature of the invention the flanges of the channel-shaped hinge bracket embrace an elongate pedestal portion of the base plate and the clamp screw screwed into the base plate extends through a slot in the web of the hinge bracket. That slot will then permit a longitudinal displacement of the hinge bracket on the base plate to a position in which the stop and counterstop bear on each other. In the hinge in accordance with the invention the lengths of the beveled or curved edge portions or surfaces of the hinge bracket or the base plate are so selected that the stop and counterstop will always be engageable with each other within the range in which a lateral adjustment can be effected.

DETAILED DESCRIPTION OF THE PREFERRED EMBODIMENT

Figure 1:
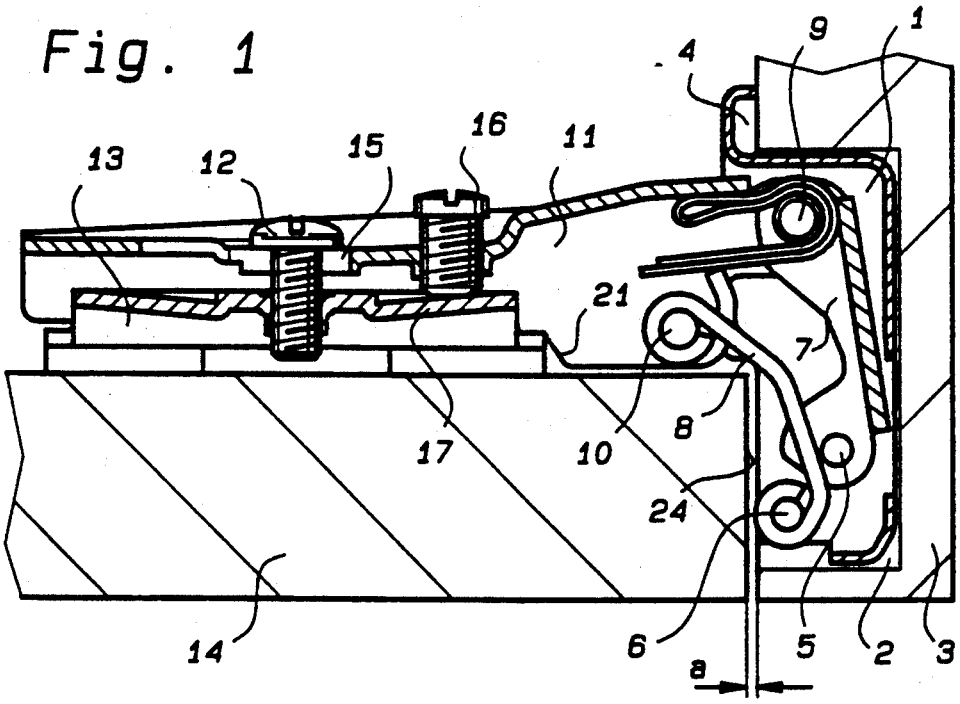
FIG. 1 is a longitudinal sectional view showing the mounted hinge in its initial position.

An illustrative embodiment of the invention will now be explained more in detail with reference to the drawing.

The hinge illustrated in the drawing comprises a cupshaped hinge member 1, which has been inserted in known manner into a milled recess 2 in the door 3 and has been secured to the door by means of screws extending through a flangelike retaining portion 4 of the hinge member 1. Links 7, 8 are mounted in the hinge cup 1 on pivot pins 5, 6 at one end of the links and at the other end are mounted on the channel-shaped hinge bracket 11 by pivot pins 9, 10. The hinge bracket 11 is clamped against the base plate 13 by the clamp screw 12 and the base plate 13 is connected to the carrying wall 14 by fixing screws or plugs, not shown. The fixing screw 12 is screwed into a central tapped bore of the base plate 13 and has a shank extending through a keyholelike slot 15 formed in the web of the hinge bracket 11.

The adjusting screw 16 is screwed into a flanged tapped hole in the web of the hinge bracket 11 and as illustrated bears on the base plate 13 and can be used to adjust the hinge bracket 11 to assume an angular position relative to the base plate 13.

The base plate 13 is substantially rectangular and in its central portion is provided with an elongate pedestallike or ramplike portion 17, which is embraced by the angled side flanges of the hinge bracket 11. Said side flanges are guided on the side faces of that pedestallike central portion.

To permit a left-hand and right-hand mounting of the door on the left and right in a simple manner, the base plate 13 is symmetrical to its transverse center line.

The hinge which has been described hereinbefore is generally of known type and for this reason will not be described further.

Adjacent to that end of the hinge bracket 11 which is adjacent to the hinge axis, the side flange 20 of the channel-shaped hinge bracket are provided with steps, which have beveled surfaces 21. The beveled surfaces 21 are adapted to bear on counter-stops 22, which are constituted by transversely extending top edge portions provided at the ends of the base plate 13.

For the mounting of the door 3, the hinge bracket 11 is placed on the base plate 13 in the usual manner and when the door is in an open position and the fixing screw 12 has been only loosely screwed into the base plate 13 the hinge bracket 11 is pushed forward until the beveled surfaces 21 bear on the counter-stops 22 of the base plate 13. When the fixing screw 12 has then been tightened, in which a gap having a predetermined width can is left between the end face 24 of the carrying wall 14 and the inside surface of the door 3. That initial position of the mounted door is apparent from FIG. 1.

Figure 2:
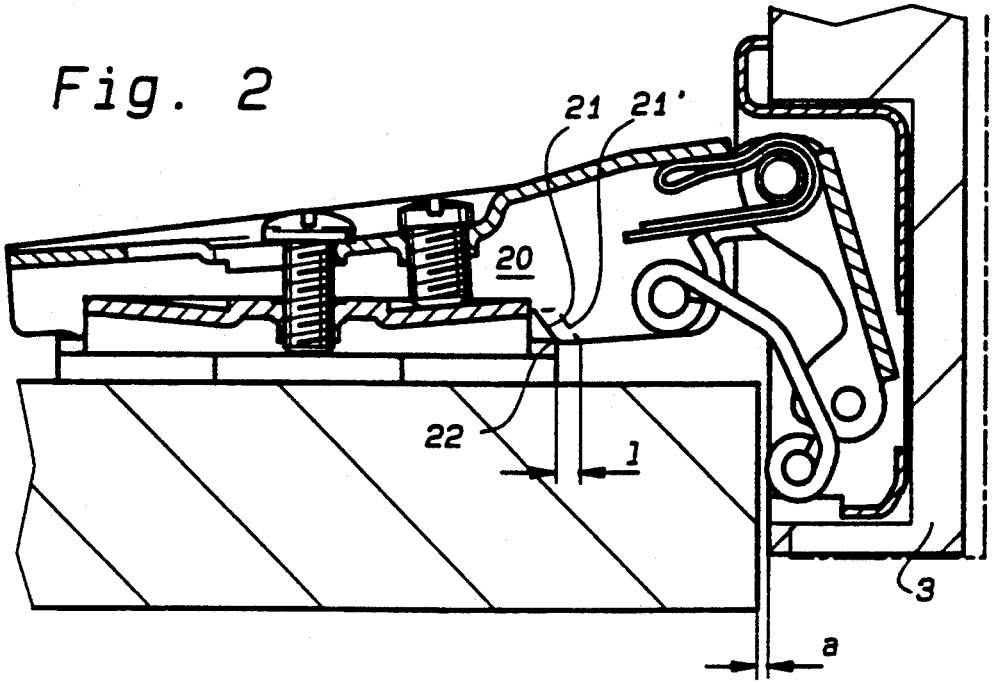
FIG. 2 is a longitudinal sectional view which is similar to FIG. 1 and shows the hinge after a lateral adjustment of the door.

For a lateral adjustment, the fixing screw 12 is slightly loosened and the adjusting screw 16 is screwed in further so that the hinge bracket 11 is pivotally moved away from the carrying wall 14. As a result, the beveled surfaces 21 of the step of the hinge bracket 11 depart from the counterstops 22. The resulting position of the beveled surfaces 21 is indicated in FIG. 2 by the dotted line 21'. The resulting position of the door is indicated in phantom. As is apparent from FIG. 2 the width of the gap between the end face 24 of the carrying wall 14 and the inside surface of the door 3 has been increased by a distance "1". Because such an angle has been selected for the beveled surfaces 22 of the hinge bracket 11 that during a pivotal movement of the hinge bracket 11, the resulting change of the width of the gap by the distance "1" will be compensated by the beveled surfaces 22, it will then be sufficient to push forward the hinge bracket 11 into engagement with the counterstop 22 so that the gap is readjusted to the predetermined width "a". When the beveled surfaces 21 have been advanced until they bear on the counterstops 22 in the position shown in FIG. 2, the fixing screw 12 is tightened and the gap has again the predetermined width "a" without a need for special adjusting operations.

The adjusting screw 16 has a head which limits the depth to which the screw 16 can be screwed into the base plate 13. As a result, the hinge bracket 11 cannot be pivotally moved beyond the angle which corresponds to the length of the beveled surfaces 21. This will ensure that the beveled surfaces 21 will always strike against the counterstop 22 when the hinge bracket 11 has been pivotally moved and is then pushed inwardly before the fixing screw 12 is tightened.

I claim:

1. A furniture hinge comprising a hinge member connected to a swinging element, and a hinge bracket connected to a stationary element through a base plate attached to the stationary element, the hinge member being connected to the bracket by link means allowing the swinging element to swing to and from a closed position wherein an inner face of the swinging element is perpendicular to an end face of the stationary element and spaced therefrom at a predetermined distance, a first screw connection between the hinge bracket and the base plate providing lengthwise adjustment of the hinge bracket relative to said end face, a second screw connection between the hinge bracket and the base plate providing pivotal adjustment of the hinge bracket relative to the base plate, first abutment surface means on the hinge bracket and second abutment surface means on the base plate engaging the first abutment surface means, at least one of said abutment surface means having a bevelled or curved profile for maintaining said predetermined distance at a constant value throughout a range of pivotally adjusted positions of the hinge bracket on the base plate by mutual engagement of the respective abutment surfaces wherein the hinge bracket is channel-shaped with opposing lengthwise walls, said walls including stepped portions defining said first abutment surface means for engaging a transversely extending edge on the base plate defining the second abutment surface means.

2. A hinge as defined in claim 1 wherein the base plate is symmetrical about a transverse center line for left and right hand mounting of the hinge bracket.

3. A hinge as define in claim 1 wherein the first screw connection comprises a headed screw extending through a lengthwise elongate slot in the hinge bracket into a threaded aperture in the base plate.

4. A furniture hinge comprising a hinge member connected to a swinging element, and a hinge bracket connected to a stationary element through a base plate attached to the stationary element, the hinge member being connected to the bracket by link means allowing the swinging element to swing to and from a closed position wherein an inner face of the swinging element is perpendicular to an end face of the stationary element and spaced therefrom at a predetermined distance, a first screw connection between the hinge bracket and the base plate providing lengthwise adjustment of the hinge bracket relative to said end face, a second screw connection between the hinge bracket and the base plate providing pivotal adjustment of the hinge bracket relative to the base plate, and abutment surfaces on the hinge bracket and base plate respectively, said abutment surfaces being mutually profiled for maintaining said predetermined distance at a constant value throughout a range of pivotally adjusted positions of the hinge bracket on the base plate by mutual engagement of the respective abutment surfaces wherein the second screw connection comprises a headed screw extending through a threaded aperture in the hinge bracket into engagement on an upper surface of the base plate, the headed screw having a head above the hinge bracket for limiting pivotal movement of the hinge bracket to an angle corresponding with a range of engagement of the abutment surfaces.

5. A furniture hinge as claimed in claim 4, wherein at least one of said abutment surfaces has a bevelled or a curved profile.

* * * * *